US009080416B2

(12) United States Patent
Xu et al.

(10) Patent No.: US 9,080,416 B2
(45) Date of Patent: Jul. 14, 2015

(54) SETTING TOOL, ANCHORING AND SEALING DEVICE AND SYSTEM

(75) Inventors: YingQing Xu, Tomball, TX (US); Gregory Lee Hern, Porter, TX (US); Douglas J. Lehr, The Woodlands, TX (US)

(73) Assignee: Baker Hughes Incorporated, Houston, TX (US)

( * ) Notice: Subject to any disclaimer, the term of this patent is extended or adjusted under 35 U.S.C. 154(b) by 218 days.

(21) Appl. No.: 13/584,328

(22) Filed: Aug. 13, 2012

(65) Prior Publication Data

US 2014/0041857 A1 Feb. 13, 2014

(51) Int. Cl.

| | |
|---|---|
| ***E21B 33/128*** | (2006.01) |
| ***E21B 33/129*** | (2006.01) |
| ***E21B 43/26*** | (2006.01) |
| ***E21B 33/134*** | (2006.01) |
| ***E21B 23/01*** | (2006.01) |
| ***E21B 33/12*** | (2006.01) |

(52) U.S. Cl.

CPC ..... *E21B 33/128* (2013.01); *E21B 23/01* (2013.01); *E21B 33/12* (2013.01); *E21B 33/129* (2013.01); *E21B 33/134* (2013.01); *E21B 43/26* (2013.01)

(58) Field of Classification Search

CPC ... E21B 33/1285; E21B 33/128; E21B 23/06; E21B 33/12; E21B 33/34; E21B 33/122; E21B 23/01; E21B 33/134; E21B 33/129; E21B 43/26

USPC ..... 166/387, 120, 179, 118, 206

See application file for complete search history.

(56) References Cited

U.S. PATENT DOCUMENTS

| | | | | |
|---|---|---|---|---|
| 3,602,305 | A | 8/1971 | Kisling, III | |
| 4,784,226 | A | 11/1988 | Wyatt | |
| 2002/0096365 | A1 | 7/2002 | Berscheidt et al. | |
| 2004/0216868 | A1 * | 11/2004 | Owen, Sr. | 166/134 |
| 2004/0251025 | A1 | 12/2004 | Giroux et al. | |
| 2007/0227745 | A1 | 10/2007 | Roberts et al. | |
| 2010/0326650 | A1 | 12/2010 | Tran et al. | |
| 2013/0319668 | A1 | 12/2013 | Tschetter et al. | |

OTHER PUBLICATIONS

Martin P. Coronado, "Development of an Internal Coiled Tubing Connector Utilizing Permanent Packer Technology"; Society of Petroleum Engineers, SPE Paper No. 46036; Apr. 15, 1998; 10 pages.

M.T. Triolo et al., "Resolving the Completion Engineer's Dilemma: Permanent or Retrievable Packer?"; Society of Petroleum Engineers, SPE Paper No. 76711; May 20, 2002; 16 pages.

International Preliminary Report on Patentability; PCT/US2013/050475; Mailed Feb. 26, 2015; 10 Pages.

* cited by examiner

*Primary Examiner* — Yong-Suk (Philip) Ro

(74) *Attorney, Agent, or Firm* — Cantor Colburn LLP

(57) ABSTRACT

An anchoring and sealing device includes at least one slip, a seal and a tubular in operable communication with the at least one slip and the seal. The anchoring and sealing device is configured to cause radial movement of the at least one slip into anchoring engagement with a structure and to cause radial movement of the seal into sealing engagement with the structure in response to longitudinal compression of the anchoring and sealing device. The anchoring and sealing device is also configured to maintain anchoring and sealing engagement with the structure without additional components remaining in contact therewith.

18 Claims, 2 Drawing Sheets

SETTING TOOL, ANCHORING AND SEALING DEVICE AND SYSTEM

BACKGROUND

Tubular systems, such as those used in the completion and carbon dioxide sequestration industries often employ anchors to positionally fix one tubular to another tubular, as well as seals to seal the tubulars to one another. Although existing anchoring and sealing tools and systems for setting such tools serve the functions for which they are intended, the industry is always receptive to new systems and methods for anchoring and sealing tubulars.

BRIEF DESCRIPTION

Disclosed herein is an anchoring and sealing device. The device includes at least one slip, a seal and a tubular in operable communication with the at least one slip and the seal. The anchoring and sealing device is configured to cause radial movement of the at least one slip into anchoring engagement with a structure and to cause radial movement of the seal into sealing engagement with the structure in response to longitudinal compression of the anchoring and sealing device. The anchoring and sealing device is also configured to maintain anchoring and sealing engagement with the structure without additional components remaining in contact therewith.

Further disclosed herein is an anchoring and sealing system. The system includes at least one slip, a seal, and a tubular in operable communication with the at least one slip and the seal. The anchoring and sealing device is configured to cause radial movement of the at least one slip into anchoring engagement with a structure and to cause radial movement of the seal into sealing engagement with the structure in response to longitudinal compression of the anchoring and sealing device. A setting tool is configured to set the at least one slip into anchoring engagement with the structure and the seal into sealing engagement with the structure. The setting tool includes, a mandrel, a collet slidably engaged with the mandrel between a first position and a second position, and fingers of the collet are radially supported by the mandrel when in the first position and unsupported radially when in the second position. A releasable member is in operable communication with the mandrel and the collet and is configured to maintain the collet in the first position until forces greater than forces needed to set the at least one slip and the seal are attained.

Further disclosed herein is a setting tool. The setting tool includes a mandrel, a collet slidably engaged about the mandrel having radially deformable fingers that are prevented from radially deforming when the collet is in a first position relative to the mandrel and are allowed to radially deform when the collet is in a second position relative to the mandrel. The radially deformable fingers are engagable with a settable tool when in the first position and disengagable from the settable tool when in the second position and a release member releasably fixes the collet to the mandrel in the first position until release thereof, the release member is configured to release at loads greater than loads needed to set the settable tool.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
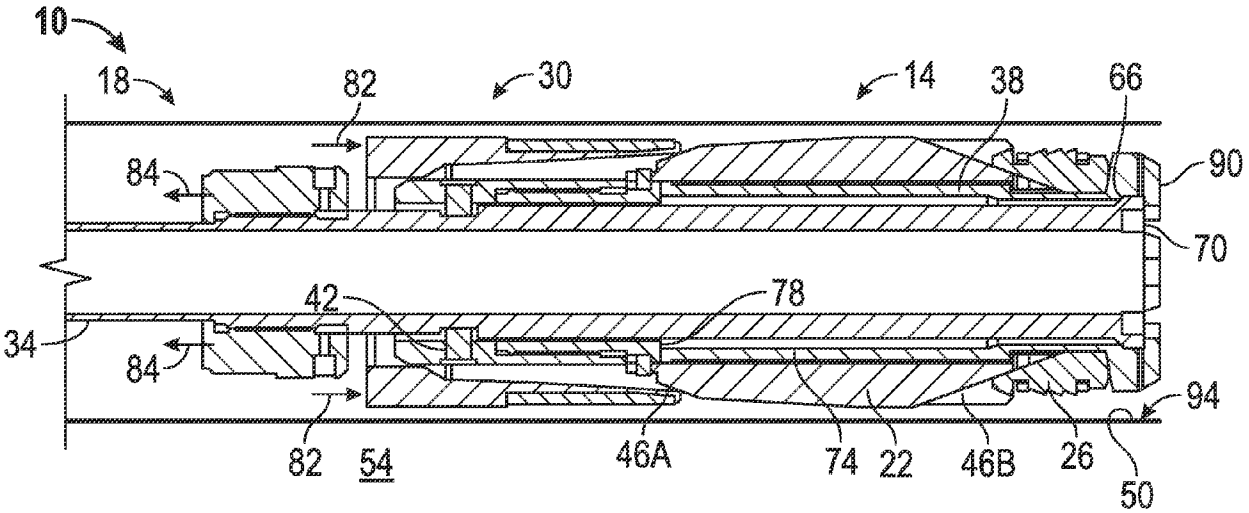
FIG. 1 depicts a cross sectional view of an anchoring and sealing system disclosed herein in a run-in position.
Figure 2:
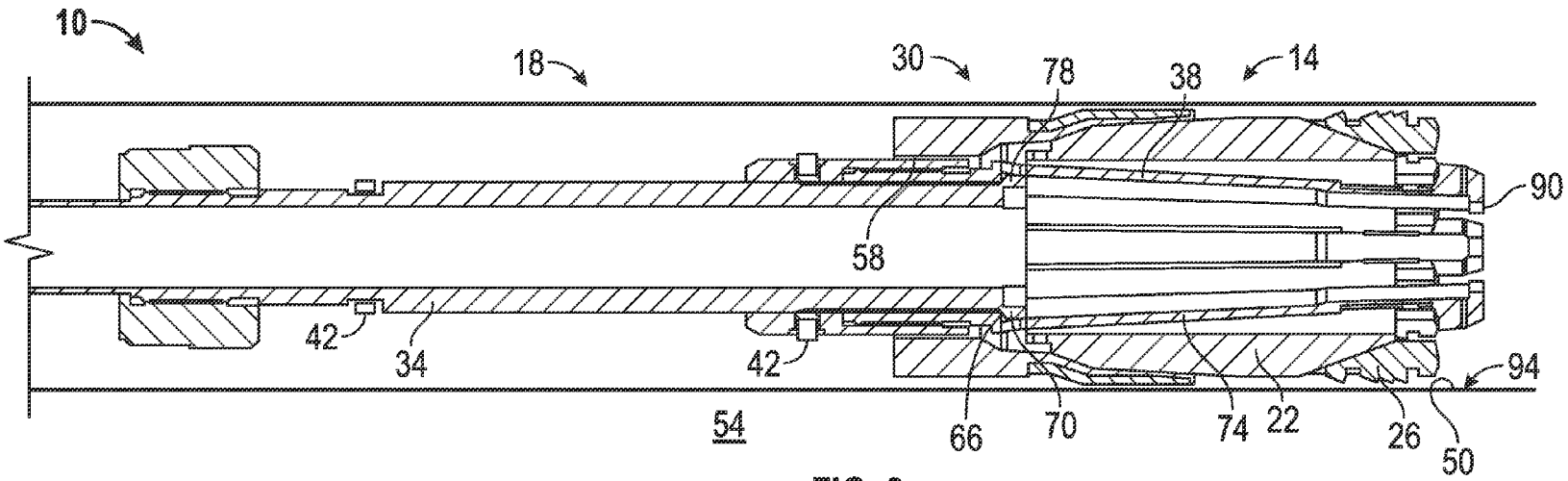
FIG. 2 depicts a cross sectional view of the anchoring and sealing system of FIG. 1 in a partially set position.
Figure 3:
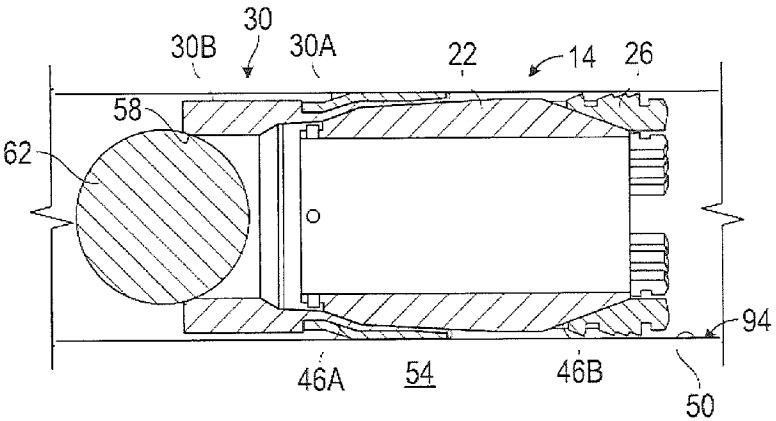
FIG. 3 depicts a cross sectional view of an anchoring and sealing device disclosed herein.

Referring to FIGS. 1, 2 and 3 an anchoring and sealing system disclosed herein is illustrated at 10. The system 10 includes a settable tool 14, illustrated herein as an anchoring and setting device that is settable by a setting tool 18. The settable tool 14 has a tubular 22, at least one slip 26 (with a plurality of slips 26 being shown in the embodiment illustrated herein), and a seal 30, and the setting tool 18 has a mandrel 34, a collet 38 and a release member 42. Both the slips 26 and the seal 30 are radially expandable upon longitudinal movement against the tubular 22. Two frustoconical surfaces 46A, 46B on the tubular 22 facilitate the radial expansion of the slips 26 and the seal 30 when moved longitudinally thereagainst. A structure 50, shown herein as a borehole in earth formation 54, is contactable by both the slips 26 and the seal 30 when they are radially expanded. Such radial expansion causes the slips 26 to anchor or longitudinally fix the settable tool 14 to the structure 50, while the seal 30 seals the tubular 22 to the structure 50 when radially expanded. The settable tool 14 is configured so that once set within the structure 50 no additional components beyond the tubular 22, the slips 26 and the seal 30 are needed for the settable tool 14 to remain set within the structure 50 as is illustrated in FIG. 3.

The settable tool 14 is settable in the structure 50 by longitudinal compression thereof. Angles of the frustoconical surface 46A, 46B as well as dimensions, materials and surface finishes of the tubular 22, the slips 26 and the seal 30 are selectable to cause either the slips 26 or the seal 30 to be set prior to the setting of the other of the slips 26 and the seal 30. In some applications it may be desirable to have the seal 30 set first so as not to cause damage to the seal 30 due to movement relative to structure 50 that could occur if the slips 26 are set before the seal 30 is set. The settable tool 14 illustrated in the embodiment of the Figures herein is a packer-type tool such as a frac plug, for example, that includes a seat 58 on the seal 30 that is sealingly receptive to a plug 62 such as a ball, for example, that is run thereagainst. The frac plug 14 allows the earth formation 54 to be fractured via pressure built against the plug 62 when seated at the seat 58. Forces against the plug 62 while seated also urge the seal 30 to wedge between the tubular 22 and the structure 50 increasing sealing integrity thereof. The frag plug 14 has a large radial opening therethrough for production of fluid therethrough, for example. This large radial opening is in part possible because the frac plug 14 doesn't need any additional components to extend longitudinally through the tubular 22 to maintain it in the set condition. The angles of the frustoconical surface 46A, 46B as well as dimensions, materials and surface finishes of the tubular 22, the slips 26 and the seal 30 are also selectable to cause the settable tool 14 to remain set within the structure 50 after the setting tool 18 has been removed. These parameters result in frictional engagement and a wedging action of the slips 26 and the seal 30 between the tubular 22 and the structure 50.

The setting tool 18 is configured to set the settable tool 14 within the structure 50. The collet 38 in the illustrated embodiment is coaxial with the mandrel 34 and is longitudinally movable relative to the mandrel 34 after the release member 42 has been released. Prior to release of the release member 42 the collet 38 is fixedly attached to the mandrel 34. Shoulder 66 on an end 70 of the mandrel 34 is longitudinally aligned with fingers 74 of the collet 38 thereby radially supporting and preventing the fingers 74 from flexing radially inwardly. This support maintains the fingers 74 in radial positions that overlap with the slips 26 thereby assuring that the fingers 74 urge the slips 26 against the frustoconical surface 46B in response to movement of the collet 38 relative to the tubular 22 to set the slips 26. This urging load is carried by the release member 42 that maintains the collet 38 in a first position (FIG. 1) relative to the mandrel 34 until the release load of the release member 42 is attained. Once attained the release member 42 releases thereby allowing the mandrel 34 to move relative to the collet 38 to the second position (FIG. 2). In the second position the fingers 74 are no longer radially supported by the mandrel 34 thereby allowing them to deform radially inwardly until they clear the slips 26 and can be pulled fully through the tubular 22 and withdrawn from all contact with the settable tool 14 (FIG. 3). During withdrawal of the collet 38 from the tubular 22 the shoulder 66 contacts a shoulder 78 on the collet 38 (this defines the second position) thereby causing the collet 38 to be withdrawn with the mandrel 34.

The force required to set the seal 30 into sealing engagement with the structure 50 can be set to a force less than that required to release the release member 42 to assure that the seal 30 fully sets prior to release of the release member 42. As mentioned above it may also be desirable to select a set force for the seal 30 that is less than that of the slips 26 to prevent relative motion between the seal 30 and the structure 50 during setting thereof. This force relationship can also be beneficial in assuring that the forces on the release member 42 are fully transferred to the setting of the seal 30 and are not absorbed by the slips 26 being engaged with the structure 50 which, if allowed to occur, could prevent full setting of the seal 30.

The seal 30 can be a single piece of a single material such as metal, or polymeric, for example. Alternately, the seal 30 can have two or more portions. The illustrated embodiment of the seal 30 includes a first portion 30A that is polymeric and a second portion 30B that is metal. The first portion 30A provides malleability to improve sealing against any imperfections in walls 94 of the structure 50. The second portion 30B provides stiffness to assure that longitudinal forces thereagainst cause the second portion 30B to slide along the frustoconical surface 46A as both the second portion 30B and the first portion 30A expand radially. Additionally, the second portion 30B can have the seat 58 thereon that is seatingly engagable with the plug 62 as discussed above.

Although not detailed in the Figures the setting tool 18 includes a portion that pushes against the seal 30 in the direction of arrows 82 in FIG. 1 while the mandrel 34 is moved in the direction of arrows 84 thereby providing longitudinal compression to the settable tool 14.

The end 70 of the mandrel 34 also abuts against protrusions 90 that project radially inwardly from the fingers 74. This assures that any loads imparted on the fingers 74 such as those due to inadvertent contact with the walls 94 while the system 10 is being run into the structure 50 will be absorbed through the mandrel 34. Such a configuration prevents these loads from being absorbed by the release member 42 that could result in undesirable and premature release or damage to the release member 42.

Figure 4:
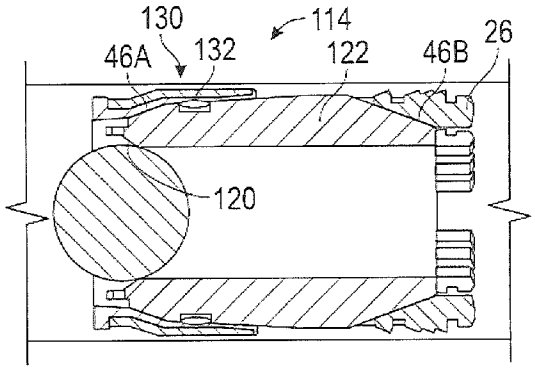
FIG. 4 depicts a cross sectional view of an alternate embodiment of the anchoring and sealing device disclosed herein.

Referring to FIG. 4, an alternate embodiment of a settable tool illustrated herein as an anchoring and sealing device is shown at 114. The settable tool 114 is similar to the settable tool 14 described above and as such like elements are identified with the same reference characters and are not again described in detail hereunder. The settable tool 114 differs from the settable tool 14 in that a seat 120 receptive to the plug 62 is located on a tubular 122 of the settable tool 114 and is not on a seal 130 as is the case in the settable tool 14. Greater loads may be supportable by the tubular 122 of the settable tool 114 than by the relatively thin walled second portion 30B of the seal 30 of the tool 14 that is designed to radially expand as it stretches over the first frustoconical surface 46A. These greater loads urge the tubular 122 toward the slips 26 thereby improving the anchoring provided by the slips 26 engaged with the second frustoconical surface 46B. An optional seal 132 may be used to slidable seal the dynamic seal 130 to the tubular 122 to prevent leakage therebetween since pressure built upstream of the plug 62 is provided to an interface between these parts unlike in the tool 14.

Figure 5:
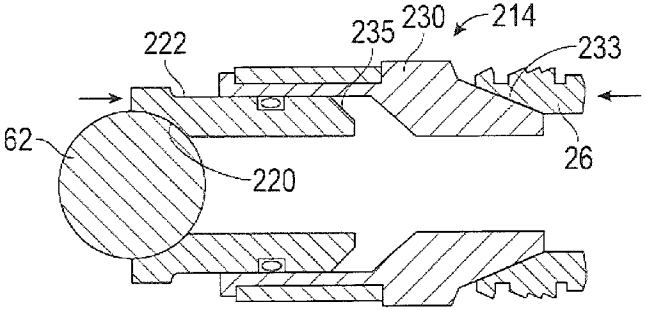
FIG. 5 depicts a cross sectional view of another alternate embodiment of the anchoring and sealing device disclosed herein.

Referring to FIG. 5, an alternate embodiment of a settable tool illustrated herein as an anchoring and sealing device is shown at 214. The settable tool 214 is similar to the settable tool 14 described above and as such like elements are identified with the same reference characters and are not again described in detail hereunder. The settable tool 214 differs from the settable tool 14 in the location and relative position of a tubular 222 relative to a seal 230. In the tool 214 the seal 230 is longitudinally between the slips 26 and the tubular 222. The seal 230 has a frustoconical portion 233 that engages with the slips 26 and the tubular 222 has a frustoconical portion 235 that engages with the seal 230. A seat 220 receptive to the plug 62 is located on the tubular 222 and as such provides additional anchor engaging forces to the slips 26 in response to pressure on the plug 62 seated thereagainst.

Figure 6:
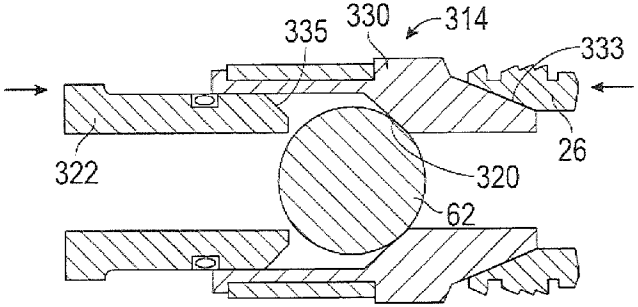
FIG. 6 depicts a cross sectional view of yet another alternate embodiment of the anchoring and sealing device disclosed herein.

Referring to FIG. 6, another alternate embodiment of a settable tool illustrated herein as an anchoring and sealing device is shown at 314. The settable tool 314 is similar to the settable tool 14 described above and as such like elements are identified with the same reference characters and are not again described in detail hereunder. The settable tool 314 differs from the settable tool 14 in the location and relative position of a tubular 322 relative to a seal 330. In the tool 314 the seal 330 is longitudinally between the slips 26 and the tubular 322. The seal 330 has a frustoconical portion 333 that engages with the slips 26 and the tubular 322 has a frustoconical portion 335 that engages with the seal 330. A seat 320 receptive to the plug 62 is located below the sealing surface (rightward in FIG. 6) on the seal 330 and as such prevents overloading the relatively thin walled portion of seal 330 in response to pressure on the plug 62.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

What is claimed:

1. An anchoring and sealing device comprising:

at least one slip;

a seal; and a tubular in operable communication with the at least one slip and the seal the anchoring and sealing device being configured to cause radial movement of the at least one slip into anchoring engagement with a structure and to cause radial movement of the seal into sealing engagement with the structure in response to longitudinal compression of the anchoring and sealing device and to maintain anchoring and sealing engagement with the structure without additional components except for the at least one slip, the seal and the tubular, the anchoring and sealing device including at least one seat receptive to a plug run thereagainst wherein pressure built against a plug seat at the at least one seat increases at least one of sealing forces between the seal and the structure and anchoring forces between the at least one slip and the structure.

2. The anchoring and sealing device of claim 1, wherein the anchoring and sealing device is a packer-type tool.

3. The anchoring and sealing device of claim 1, wherein the tubular includes two frustoconical portions on opposing longitudinal ends of the tubular.

4. The anchoring and sealing device of claim 1, wherein the seal includes the at least one seat.

5. The anchoring and sealing device of claim 1, wherein the seal includes a non-polymeric portion and a polymeric portion.

6. The anchoring and sealing device of claim 1, wherein the at least one slip and the seal are set in response to same longitudinally compressive forces being applied to the anchoring and sealing device.

7. The anchoring and sealing device of claim 1, wherein the tubular includes the at least one seat.

8. The anchoring and sealing device of claim 1, wherein the seal has a frustoconical portion in operable communication with the at least one slip.

9. The anchoring and sealing device of claim 8, wherein the tubular has a frustoconical portion in operable communication with the seal.

10. An anchoring and sealing system comprising:

at least one slip;

a seal; and a tubular in operable communication with the at least one slip and the seal the anchoring and sealing device being configured to cause radial movement of the at least one slip into anchoring engagement with a structure and to cause radial movement of the seal into sealing engagement with the structure in response to longitudinal compression of the anchoring and sealing device;

a setting tool configured to set the at least one slip into anchoring engagement with the structure and the seal into sealing engagement with the structure comprising:

a mandrel;

a collet slidably engaged with the mandrel between a first position and a second position, fingers of the collet being radially supported by the mandrel long as the collet is in the first position and unsupported radially as long as the collet is in the second position; and a releasable member in operable communication with the mandrel and the collet configured to maintain the collet in the first position until forces greater than forces needed to set the at least one slip and the seal are attained.

11. The anchoring and sealing system of claim 10, wherein the fingers are engagable with at least one of the at least one slip while being radially supported.

12. The anchoring and sealing system of claim 10, wherein the at least one slip and the seal remain set after removal of the setting tool from the at least one slip and the seal.

13. The anchoring and sealing system of claim 10, wherein the tubular, the at least one slip and the seal are all that remain anchored and sealed to the structure after removal of the setting tool from the tubular, the at least one slip and the seal.

14. The anchoring and sealing system of claim 10, wherein the setting tool is configured to prevent inadvertent setting of the at least one slip or the seal during running of the anchoring and sealing system into the structure.

15. A setting tool comprising:

a mandrel;

a collet slidably engaged about the mandrel having radially deformable fingers that are prevented from radially deforming as long as the collet is in a first position relative to the mandrel and are allowed to radially deform as long as the collet is in a second position relative to the mandrel, the radially deformable fingers being engagable with a settable tool as long as the collet is in the first position and disengagable from the settable tool as long as the collet is in the second position; and a release member releasably fixing the collet to the mandrel in the first position until release thereof, the release member being configured to release at loads greater than loads needed to set the settable tool.

16. The setting tool of claim 15, wherein the collet and the mandrel are fully removable from the settable tool after having set the settable tool.

17. The setting tool of claim 15, wherein ends of the mandrel engage with protrusions of the collet to distribute longitudinal loads in the radially deformable fingers through the mandrel instead of through the release member at least on one longitudinal direction.

18. The setting tool of claim 15, wherein the settable tool is an anchoring and sealing device.

* * * * *